US005380013A

United States Patent [19]

Nacht

[11] Patent Number: 5,380,013

[45] Date of Patent: Jan. 10, 1995

[54] APPARATUS FOR BOARD GAMES

[76] Inventor: David Nacht, Hashoftim 20/15, Kiryat Gat 82000, Israel

[21] Appl. No.: 94,419

[22] Filed: Jul. 21, 1993

[51] Int. Cl.[6] ..... A63F 3/00

[52] U.S. Cl. ..... 273/287; 273/280

[58] Field of Search ..... 273/241, 251, 252, 254, 273/273, 280, 287

[56] References Cited

U.S. PATENT DOCUMENTS

| | | | |
|---|---|---|---|
| 3,508,753 | 4/1970 | Mackey | 273/241 X |
| 3,762,714 | 10/1973 | Wilson | 273/280 |
| 3,995,862 | 12/1976 | Bertin | 273/241 |
| 4,219,196 | 8/1980 | DeCanto et al. | 273/241 X |
| 4,575,094 | 3/1986 | Ferris et al. | 273/287 |
| 4,779,874 | 10/1988 | Dykstra et al. | 273/287 X |
| 5,201,524 | 4/1993 | Csanady et al. | 273/287 X |
| 5,255,923 | 10/1993 | Bennett | 273/287 X |

FOREIGN PATENT DOCUMENTS

| | | | |
|---|---|---|---|
| 2666749 | 3/1992 | France | 273/287 |

*Primary Examiner*—William E. Stoll

*Attorney, Agent, or Firm*—Mark M. Friedman

[57] ABSTRACT

An apparatus useful in a board game which requires one or more players to reach a conclusion, such as a treasure, based on collected clues, which includes two boards which are movable relative to each other. The upper board includes a number of openings and also includes markings to facilitate movement of each player across the upper board. The lower board which may be attached to the upper board, and which is movable, e.g., rotatable, relative to the upper board, features markings. When the boards are moved relative to each other prior to the start of a game, a specific set of clue markings is aligned with the openings in the upper board. At least some of the clue markings are, or are related to, the clues needed to arrive at the conclusion.

14 Claims, 3 Drawing Sheets

40

| CLUE MARKING | CLUE |
|---|---|
| 1 | LOOK UNDER BRIDGE |
| 2 | • |
| 3 | • |
| 4 | • |
| 5 | • |
| 6 | • |
| 7 | • |
| 8 | • |
| 9 | • |
| 10 | GO 5 STEPS BACK |
| 11 | • |
| 12 | • |
| 13 | • |
| 14 | • |
| 15 | • |
| 16 | • |
| 17 | • |
| 18 | • |
| 19 | • |
| 20 | GO WEST YOUNG MAN |

| CLUE MARKING | CLUE |
|---|---|
| 21 | LOOK BEHIND THE HOUSE |
| 22 | • |
| 23 | • |
| 24 | • |
| 25 | • |
| 26 | • |
| 27 | • |
| 28 | • |
| 29 | • |
| 30 | • |
| 31 | • |
| 32 | • |
| 33 | • |
| 34 | TURN TO THE RIGHT |
| 35 | • |
| 36 | • |
| 37 | • |
| 38 | • |
| 39 | • |
| 40 | GO SOUTH YOUNG MAN |

FIG.5

42

| CLUE MARKING | CLUE |
|---|---|
| 1 | LOOK UNDER BRIDGE |
| 2 | • |
| 3 | • |
| 4 | • |
| 5 | • |
| 6 | • |
| 7 | • |
| 8 | • |
| 9 | • |
| 10 | GO 5 STEPS BACK |

| CLUE MARKING | CLUE |
|---|---|
| 11 | • |
| 12 | • |
| 13 | • |
| 14 | • |
| 15 | • |
| 16 | • |
| 17 | • |
| 18 | • |
| 19 | • |
| 20 | GO WEST YOUNG MAN |

FIG.6

APPARATUS FOR BOARD GAMES

FIELD AND BACKGROUND OF THE INVENTION

The present invention relates to board games and, more particularly, to board games wherein the players are required to gather clues or hints in order to determine a secret location or reach some conclusion.

A large variety of board games are currently available. A portion of these are based on the idea of requiring the players to gather a set of clues or directions. Once enough clues or directions have been gathered, the player is able to reach a conclusion, such as the location of the treasure, the identity of the killer, and the like.

A disadvantage of many of these board games is that they include limited number of scenarios so that after the players have become sufficiently experienced with the game, they begin to be familiar with the scenarios and are able to reach the proper conclusion even without gathering the clues. At this point the game loses the interest of the players and fails into disuse. Another disadvantage of a significant number of these games it that they require one or more of the players, or a non-player, to select or pre-determine the location of the treasure or the like, which makes it difficult or impossible for a single player to enjoy such games.

There is thus a widely recognized need for, and it would be highly advantageous to have, an apparatus which can be used as part of board games as described above but wherein the scenario of the board game could be preset randomly and blindly prior to each game from a large number of available scenarios.

SUMMARY OF THE INVENTION

According to the present invention, there is provided a board game requiring one or more players to reach a conclusion based on collected clues, comprising: (a) an upper board including a plurality of openings and further including movement markings to facilitate movement of a playing piece across the upper board; and (b) a lower board, including clue markings, the lower board being movable relative to the upper board such that a different set of the clue markings is aligned with plurality of openings in the upper board for different relative positions of the upper board and the lower board, at least some of the set of aligned markings being, or being related to, clues needed to arrive at the conclusion.

According to further features in preferred embodiments of the invention described below, the upper and lower boards contact each other, and are preferably rotatable with respect to each other, most preferably the lower board being rotatable relative to the upper board about a pivot connected to the upper board.

According to still further features in the described preferred embodiments, the upper board includes a plurality of movement and location markings, whereas the lower board features clue markings which are, or which are related to, clues needed to arrive at the conclusion.

The present invention successfully addresses the shortcomings of the presently known configurations by providing a board game apparatus which includes a very large number of separate possible scenarios one of which may be randomly selected prior to the start of the game.

Before the start of each game the upper board or lower board (or both) is (are) moved so as to change the relative positions of the two boards with respect to each other. The selected relative position of the two boards brings into alignment a new set of clues represented on the lower board with the fixed openings in the upper board. In this way, before each game, a completely new scenario can be selected in near-random fashion.

BRIEF DESCRIPTION OF THE DRAWINGS

The invention is herein described, by way of example only, with reference to the accompanying drawings, wherein:

FIG. 5 schematically depicts cards such as might include clue markings and corresponding clues;

FIG. 6 schematically depicts a book such as might include clue markings and corresponding clues;

DESCRIPTION OF THE PREFERRED EMBODIMENTS

The present invention is of an apparatus for use with various board games, and the like, especially those board games which are based on the searching for a conclusion based on the collection of a series of clues, tier example, seeking the location of a treasure based on clues which point to, or hint at, the desired location.

The principles and operation of a board game apparatus according to the present invention may be better understood with reference to the drawings and the accompanying description.

Figure 1:
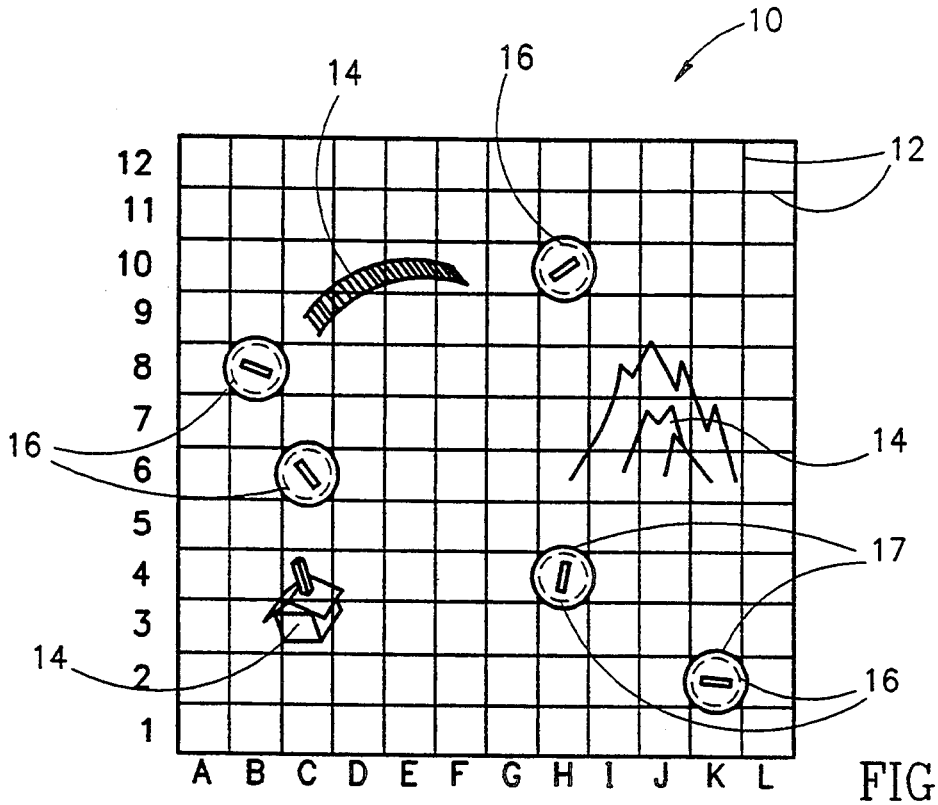
FIG. 1 is a top view of an illustrative upper board featuring, for illustration purposes, five openings and movement and location markings.

Referring now to the drawings, FIG. 1 illustrates one of a great variety of possible upper boards which can be used in an apparatus according to the present invention. The upper board 10 can be made of any suitable material, including, but not limited to, cardboard, plastic, wood and metal, and is generally planar in shape. The precise shape and dimensions of upper board 10 will vary with the intended application.

The upper face of upper board 10 may, but need not necessarily, include various markings. These will generally fall into at least two categories. Movement markings 12 are for the purpose of facilitating the movement of the game pieces of the player or players (hereinafter "player") across upper board 10. Countless schemes are known and can be envisioned for accomplishing the movement of the player across the board. For example, upper board 10, illustrated in FIG. 1, features horizontal and vertical lines which divide the board into a series of squares, which may, if desired, be identified by letter and number coordinates (as in FIG. 1). The players may move from place to place across upper board 10 via any suitable mechanisms, including, but not limited to, the throwing of dice (not shown) and/or the spinning of a suitable spinner and/or following directions on a drawn card, and the like.

Upper board 10 may also include a second set of markings which are intended to depict various locations or other information (hereinafter "location markings"). For example, upper board 10 depicted in FIG. 1 includes location markings 14 which depict a bridge, a mountain and a house.

Upper board 10 used in conjunction of the present invention includes a plurality of openings 16. The number of openings 16 will depend on the particular board game but could range from as few as two or three for very simple games designed for young children to one hundred or more openings for more sophisticated games. For ease of presentation, only five openings 16 are used in FIG. 1. Openings 16 are holes cut through upper board 10 so as to allow a player to see through upper board 10, as will be described in more detail below. The size and shape of openings 16 will be chosen to best fit the intended application. Each opening 16 is preferably equipped with a removable cover 17 of suitable design which prevents the players from seeing through upper board 10 except when the cover is removed from opening 16.

Located below upper board 10 is a lower board 18. Two examples of such lower boards are given in FIGS. 2 and 3. Lower board 18, like upper board 10, may be of any suitable size and shape and may be made of any suitable material. Lower board 18 and upper board 10 are designed to displace and/or rotate relative to each other. This can be accomplished by moving upper 10 or by moving lower board 18 or by moving both boards. Preferably, upper board 10 remains stationary on the playing table (not shown) while lower board 18 can be moved, either translated as in FIG. 2 or rotated as in FIG. 3, or both, to bring about the change in relative position of the two boards. Reference will henceforth be made to movement of lower board 18, it being understood is that the intent is to achieve changes in the relative positions of the two boards and that this can be accomplished by movements of either or both boards, all of which movements are intended to be included by reference to movement of lower board 18.

Lower board 18 includes on its upper surface, i.e., the surface nearest upper board 10, a series of clue markings 20 at least some of which are, or are related to, as described below, the clues needed to arrive at the conclusion, for example, the determination of the location of a treasure or the uncovering of the identity of the murderer. Preferably, one of clue markings 20 includes the conclusion, or its designation, and can be used at the end of the game to verify the correctness of the conclusion reached by the player or players. Each of clue markings 20 may be a single item or may be, for example, four different items, each of which is intended for each of the four player who may all be seeking the same conclusion through separate sets of clues or who may each be seeking different conclusions.

Lower board 18 is movable relative to upper board 10 such that a different set of clue markings 20 is aligned with openings 16 in upper In operation, the two boards will lie aligned one on top of the other, preferably in contact, most preferably suitably attached to each other so as to preserve the alignment of the two boards throughout each game. Prior to the start of each game, lower board 18 would be made to slide to the right or left so as to bring into alignment a set of clue markings 20 and 0 openings 16. To facilitate alignment, it may be desirable to have one of openings 16 serve as an alignment opening which is not covered and which indicates proper alignment whenever a certain shape, for example, a circle of suitable diameters, is centered in the alignment opening.

Figure 2:
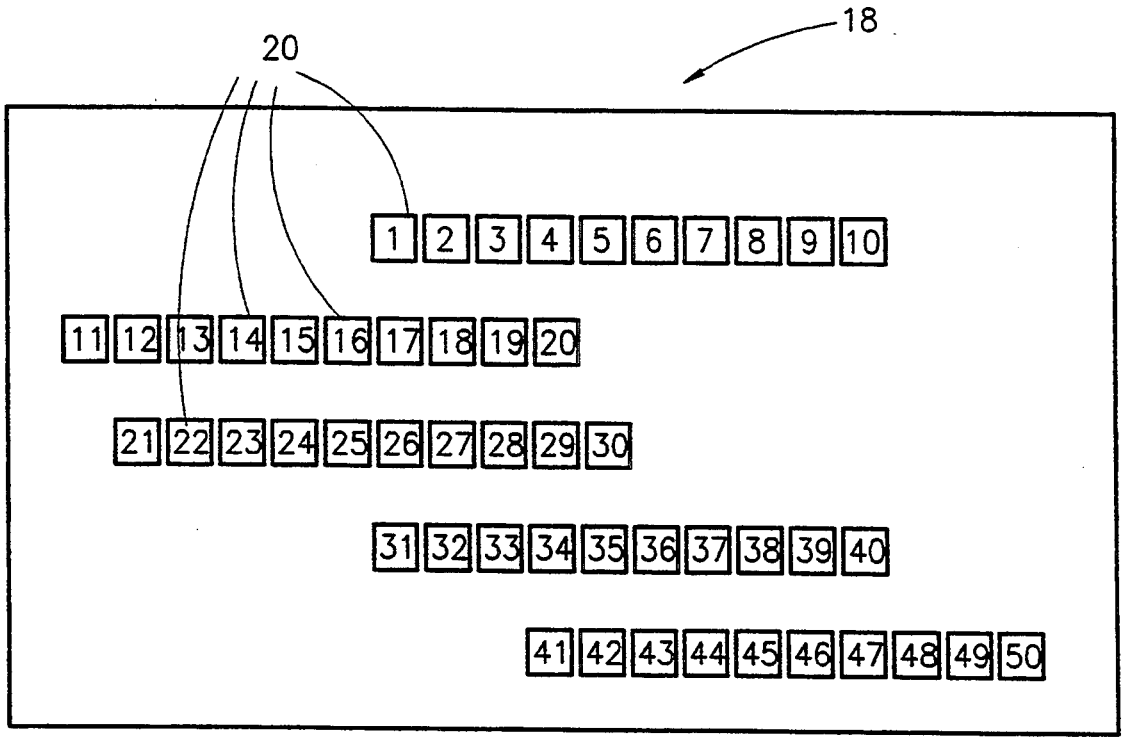
FIG. 2 is a top view of one embodiment of a lower board for use with the upper board of FIG. 1 which is designed to slide with respect to the upper board and which features, for purposes of illustration, ten scenarios featuring a total of 50 (10 scenarios×5 openings) clue markings.

For illustrative purposes, ten different scenarios are depicted in lower board 18 of FIG. 2, i.e., for each of the five openings 16 of upper board 10 there are ten possible corresponding clues or clue designations 20 on lower board 18. The location of the five sets of clue markings 20 corresponds with the location of openings 20. The spacing between each pair of adjoining clues markings 20 within a single set is constant and corresponds to the distance through which lower board 18 must be moved to be aligned with the next scenario.

Thus, for example, prior to a particular game, the two boards will be placed such that the fourth clue marking from left in each of the five clue sets will be aligned with openings 16. The players will move around the board based on some pre-determined rules, which may involve the throwing of dice, the spinning of spinners, the drawing of cards, and the like. When a player gets to an opening 16, he is allowed to lift the corresponding cover so that he or she, but not his competitors, will be able to see the information on lower board 18 which is directly aligned with the specific opening. That information may be a clue or, especially in more sophisticated applications having many openings where space is at a premium, a designation of a clue. For example, the marking may be a number, e.g., '3178' which sends the player to a separate listing of clues (not shown) where the full text of the clue is to be found. The separate listing of clues may be located in cards 40 FIG. 5) or in special listings or books, 42 (FIG. 6) and the like. The player may copy the clue, or make notes and proceed to collect additional clues. Clue markings 20 may be of any suitable type, including, but not limited to, numbers, letters, alphanumeric combinations, icons, drawings, photographs, and the like.

Once a sufficient number of clues has been gathered, the player may be able to reach the proper conclusion, for example, the identity of a fictional or historical personality or event, the location of a treasure or an actual geographical location, and the like.

As will be readily envisioned, the conclusion may be of virtually any type, making an apparatus according to the present invention highly versatile. For example, a simple version of a game, designed for young children, could have just a few openings and very simple clues. For more sophisticate audiences, the game could include hundreds of clues for each scenario and the conclusions may be in virtually any field, making the game potentially highly educational. Furthermore, upper board 10 and/or lower board 18, or at least their respective markings, could be made to be interchangeable with a virtually unlimited series of other boards and markings so that the same basic structure could be used to play a game based on seeking a treasure in a make-believe island and could later be used to try to identify a particular Shakespeare play.

Figure 3:
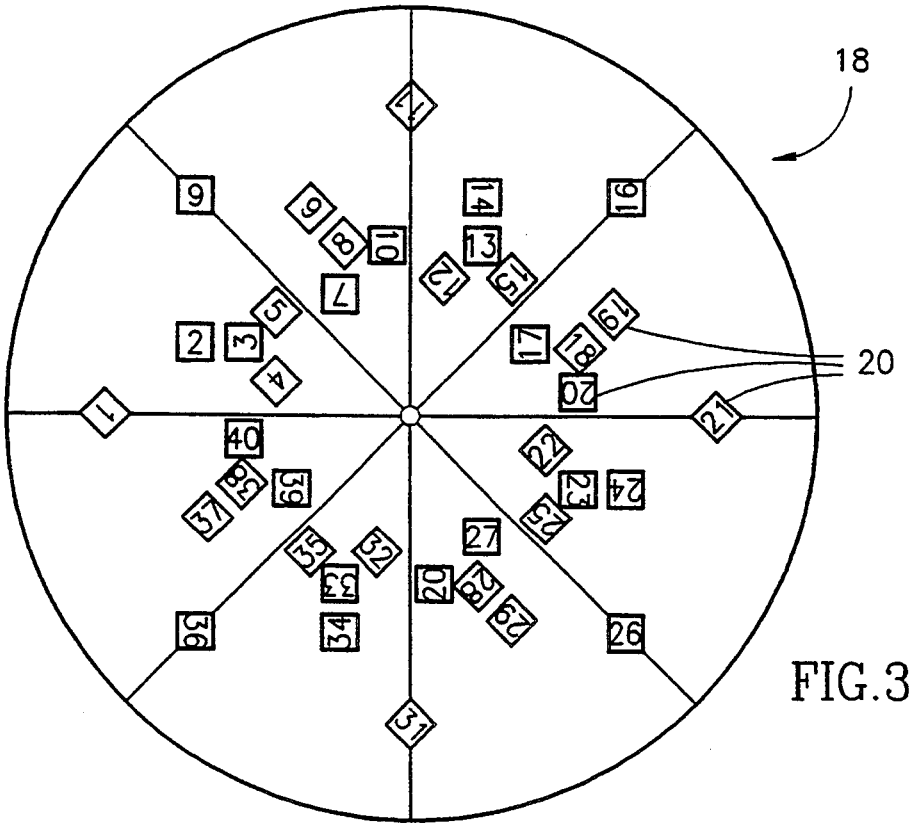
FIG. 3 is a top view of a preferred embodiment of a lower board for use with the upper board of FIG. 1 which is designed to rotate with respect to the upper board and which features, for purposes of illustration, eight scenarios featuring a total of 40 (8 scenarios×5 openings) clue markings.
Figure 4:
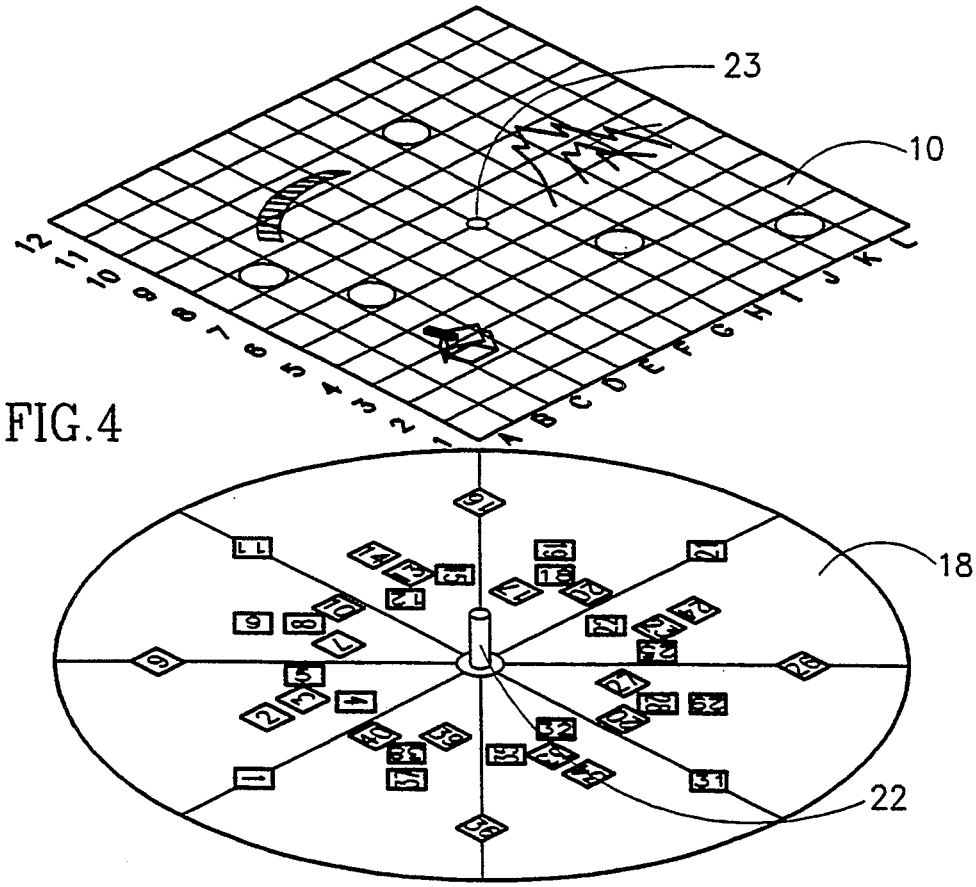
FIG. 4 is an exploded perspective view of the upper board of FIG. 1 and the lower board of FIG. 3 showing their relative positions.

Shown in FIG. 3 is a preferred embodiment of lower board 18. Here lower board is roughly circular in shape and is rotatable with respect upper board 10 about a certain pivot 22. Preferably, pivot 22 is connected, most preferably, detachably connected, to a suitable point 23 on upper board 10, as shown in the exploded view in FIG. 4.

Circular lower board 18 of FIG. 3 shows the markings, which again have been numbered to show their correspondence with openings 16 of upper board 10. The particular lower board 18 shown in FIG. 3 features eight scenarios. It should be noted that each adjoining pair of clue markings 20 in each of the five sets are offset from each other by a constant angle, so that a suitable rotation of lower board 18 will bring into alignment one of the eight sets of clues.

The embodiment of FIG. 3 is preferred over that of FIG. 2 for at least two reasons. First, the circular lower board 18 (FIG. 3), although rotatable with respect to upper board 10 is not displaceable relative to it. Thus, the active area of circular lower board 18 (FIG. 3) can be of roughly the same extent as the active area of upper board 10. By contrast, the active area of rectangular lower board 18 (FIG. 2) must be larger than that of upper board 10.

A more significant advantage of circular lower board 18 (FIG. 3) is that the circular nature of the board makes the selection of a scenario more random than the selection of a scenario using rectangular lower board 18 (FIG. 2). This is because circular lower board 18 (FIG. 3) is continuous, having no beginning or end, which makes it impossible for the person selecting the scenario to try to steer the selection of the scenario toward a particular set of scenarios.

While the invention has been described with respect to a limited number of embodiments, it will be appreciated that almost endless variations, modifications and other applications of the invention may be made, all of which are intended to fall within the scope of the present invention.

What is claimed is:

1. A board game requiring one or more players to reach a conclusion based on collected clues, comprising:

(a) an upper board including a plurality of openings and further including movement markings to facilitate movement of a playing piece across said upper board; and (b) a lower board, including clue markings, said lower board being movable relative to said upper board such that a different set of said clue markings is aligned with said plurality of openings in said upper board for different relative positions of said upper board and said lower board, at least some of said set of aligned markings being, or being related to, clues needed to arrive at the conclusion.

2. An apparatus as in claim 1 wherein said upper board and said lower board contact each other.

3. An apparatus as in claim 1 wherein said lower board is rotatable with respect to said upper board.

4. An apparatus as in claim 3 wherein at least some of said aligned clue markings are designations related to clues needed to arrive at the conclusion.

5. An apparatus as in claim 4 wherein said designations are selected from the group consisting of numbers, letters, alphanumeric groupings, and icons.

6. An apparatus as in claim 1 wherein said lower board is rotatable with respect to a pivot connected to said upper board.

7. An apparatus as in claim 1 wherein said upper board further includes a plurality of location markings to indicate various locations on said upper board.

8. An apparatus as in claim 1 wherein at least some of said aligned clue markings are clues needed to arrive at the conclusion.

9. An apparatus as in claim 1 wherein at least some of said aligned clue markings are designations related to clues needed to arrive at the conclusion.

10. An apparatus as in claim 9 wherein said clues are printed on a separate medium, said medium being selected from the group consisting of individual cards and a book of clues.

11. An apparatus as in claim 1 wherein at least one of said aligned clue markings features the conclusion.

12. An apparatus as in claim 1 wherein said upper board or said upper board markings are interchangeable with other upper boards and upper board markings, respectively.

13. An apparatus as in claim 1 wherein said lower board or said clue markings are interchangeable with other lower boards and clue markings, respectively.

14. An apparatus as in claim 1 further comprising removable covers for alternately covering and uncovering said openings in said upper board.

* * * * *